US005255444A

United States Patent [19]

Oess

[11] Patent Number: 5,255,444

[45] Date of Patent: Oct. 26, 1993

[54] MICROWAVE DRYING/MIXING APPARATUS

[75] Inventor: Jürgen Oess, Dachau, Fed. Rep. of Germany

[73] Assignee: Krauss-Maffei Aktiengesellschaft, Munchen, Fed. Rep. of Germany

[21] Appl. No.: 830,714

[22] Filed: Feb. 4, 1992

[30] Foreign Application Priority Data

Feb. 6, 1991 [DE] Fed. Rep. of Germany ..... 4103455

[51] Int. Cl.[5] ..... B01K 5/00

[52] U.S. Cl. ..... 34/1 P; 219/10.55 A

[58] Field of Search ..... 34/1 P, 1 Q, 1 S, 1 T, 34/1U, 1V; 219/10.55 R, 10.55 A

[56] References Cited

U.S. PATENT DOCUMENTS 3,775,863 12/1963 Updegrove .
3,777,095 12/1973 Muranaka .
3,834,038 9/1974 Janda .

FOREIGN PATENT DOCUMENTS 0333423 9/1923 European Pat. Off. .
187173 7/1986 European Pat. Off. .
306563 3/1989 European Pat. Off. .
312741 4/1989 European Pat. Off. .
403951 12/1990 European Pat. Off. .
437267 7/1991 European Pat. Off. .
3814451 11/1988 Fed. Rep. of Germany .
3923841 12/1988 Fed. Rep. of Germany .
8904885 7/1989 Fed. Rep. of Germany .
3907248 9/1990 Fed. Rep. of Germany .
2641491 7/1990 France .

OTHER PUBLICATIONS

Patent Abstract of Japan M-971, dated Feb. 19, 1990.
Patent Abstract of Japan, E-736, Mar. 1989.

*Primary Examiner*—Henry A. Bennet
*Attorney, Agent, or Firm*—Herbert Dubno; Andrew Wilford

[57] ABSTRACT

A drying apparatus has a generally conical upwardly flared housing having an upper end provided with a cover and a lower end provided with an outlet, a mixing auger mounted on and extending upward from the lower housing end in the housing and rotatable to mix particulate material in the housing, and a magnetron mounted at the upper housing end and directed downward inside the housing to irradiate and heat the particulate material in the housing. The magnetron can be mounted directly on the cover. An adapter ring can be provided on the upper end of the housing between the housing and the cover with the magnetron mounted on this adapter ring. This ring is releasably connected to the cover and housing, and it is possible for the ring to carry a plurality of such magnetrons each provided with a respective coaxial wave guide extending through the ring and into the housing.

3 Claims, 1 Drawing Sheet

MICROWAVE DRYING/MIXING APPARATUS

FIELD OF THE INVENTION

The present invention relates to an apparatus for drying and mixing particulate material. More particularly this invention concerns such an apparatus which uses microwave energy as a heat source.

BACKGROUND OF THE INVENTION

Microwave energy is a particularly convenient method of heating wet material to dry it as described in German patent document 3,814,451 of H. K. Werner, European patent application 333,423 of N. Arai, and Japanese patents 2-52981 and 63-299086. In addition equipment is known which simultaneously agitates or mixes particulate material while irradiating it with microwave radiation. See German patent documents 3,907,248 and 3,923,841 respectively of B. Lelanz and K. Satow, German Utility Model 8,904,885, French patent 2,641,491 of R. Patrick, and U.S. Pat. Nos. 3,777,095 and 3,834,038 respectively of T. Muranaka and R. Janda.

A standard auger-type mixer, such as described in U.S. Pat. No. 3,775,863 of L. Updegrove, has a basically conical and upwardly flared housing in which is provided an auger having an upper end mounted on the outer end of an arm whose inner end is pivoted in the cover of the housing about its central axis so that rotation of the arm orbits the auger inside the housing, churning the contents thereof. The walls and/or auger of such a device are heated to transmit heat to the contents and dry them. In an improvement on such a device to be used for drying particulate material, European patent application 306,563 of I. Sato proposes mounting a magnetron, that is a microwave emitter, in the cover of the housing.

Such an arrangement is fairly effective, but the orbiting auger arm periodically passes underneath the magnetron, blocking it and causing it to heat the auger drive rather than the actual contents of the housing.

OBJECTS OF THE INVENTION

It is therefore an object of the present invention to provide an improved apparatus for mixing and drying particulate material.

Another object is the provision of such an improved apparatus for mixing and drying particulate material which overcomes the above-given disadvantages, that is which operates with a high degree of efficiency.

A further object is to provide an improved such system which can be retrofitted to an existing auger-type conical-housing mixer/dryer.

SUMMARY OF THE INVENTION

A drying apparatus according to the invention has a generally conical upwardly flared housing having an upper end provided with a cover and a lower end provided with an outlet, a mixing auger mounted on and extending upward from the lower housing end in the housing and rotatable to mix particulate material in the housing, and a magnetron mounted at the upper housing end and directed downward inside the housing to irradiate and heat the particulate material in the housing. The magnetron can be mounted directly on the cover.

In order to leave room for the input port, a vapor filter, a sight glass, and the like and to make it possible to retrofit the inventive system to a existing conical-housing mixer, an adapter ring is provided on the upper end of the housing between the housing and the cover and the magnetron is mounted on this adapter ring. This ring is releasably connected to the cover and housing, and it is possible for the ring to carry a plurality of such magnetrons each provided with a respective coaxial wave guide extending through the ring and into the housing. In fact several waveguides can extend from a single magnetron to distribute the microwave radiation while minimizing the expense for the expensive magnetrons.

BRIEF DESCRIPTION OF THE DRAWING

The above and other objects, features, and advantages will become more readily apparent from the following, reference being made to the accompanying drawing in which.

SPECIFIC DESCRIPTION

Figure 1:
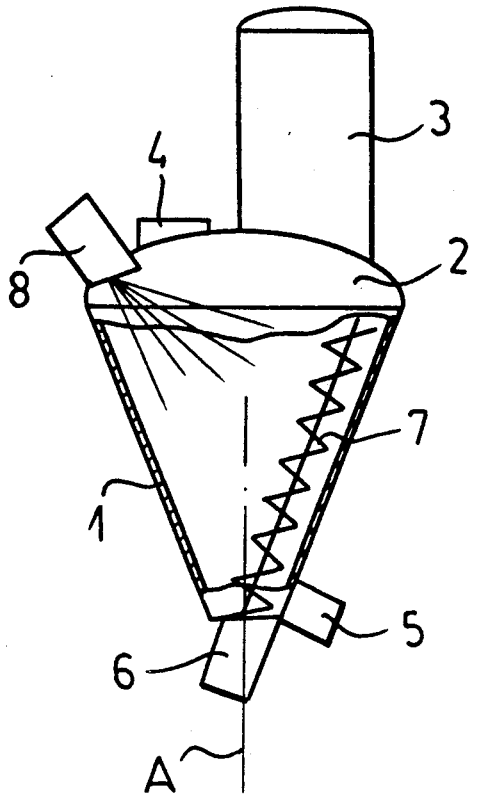
FIG. 1 is a small-scale side view partly in vertical section through a drying/mixing apparatus according to the invention.

As seen in FIG. 1 a generally conical housing 1 centered on a vertical axis A is provided with a domed cover 2 itself provided with a vapor filter 3 and an inlet opening 4. At its narrow bottom end the housing 1 has a lateral product outlet 5 and a drive 6 for an inclined product-mixing auger 7. According to the invention the cover 2 is fitted offset from the axis A on its side opposite the auger 7 with a magnetron 8 that projects microwave radiation into the interior of the housing 1 to irradiate ate and heat particles therein. Thus particles to be dried are loaded into the housing 1 through the inlet 4 and are simultaneously heated and mixed, ultimately exiting through the outlet 5.

Figure 2:
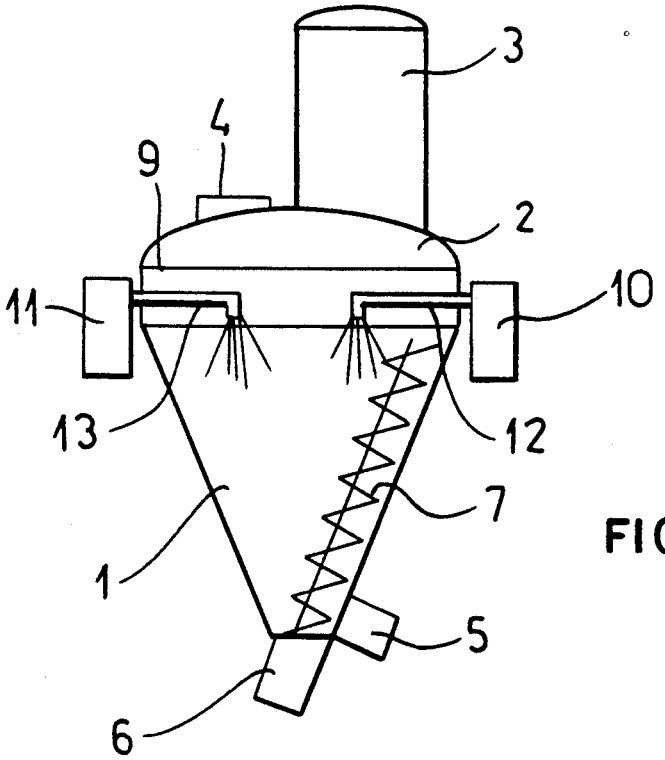
FIG. 2 is a view like FIG. 1 of another system according to the invention.

The system of FIG. 2 is identical in function to that of FIG. 1 except that it is provided between the cover 2 and the housing 1 with a cylindrical adapter ring 9 carrying two diametrally opposite magnetrons 10 and 11 having coaxial wave guides 12 and 13 extending in to the housing interior and having downward directed ends. This system is particularly advantageous for retrofitting a conventional mixer with a microwave heater.

I claim:

1. A drying apparatus comprising:

a generally upwardly flared housing having an upper end provided with a cover and a lower end provided with an outlet;

a mixing auger mounted on and extending upward from the lower housing end in the housing and rotatable to mix particulate material in the housing;

drive means on the lower housing end connected to the auger for rotating same in the housing;

an adapter ring on the upper end of the housing between the housing and the cover; and a microwave magnetron mounted at the upper housing end on the adapter ring and directed downward inside the housing to irradiate and heat the particulate material in the housing.

2. The drying apparatus defined in claim 1 wherein the ring is releasably connected to the cover and housing.

3. The drying apparatus defined in claim 1 wherein the ring carries a plurality of such magnetrons each provided with a respective coaxial wave guide extending through the ring and into the housing.

* * * * *